US007475922B2

(12) United States Patent
Ottino et al.

(10) Patent No.: US 7,475,922 B2
(45) Date of Patent: Jan. 13, 2009

(54) LOCK FOR A DOOR OF A MOTOR VEHICLE

(75) Inventors: Franco Giovanni Ottino, Giuliano Terme (IT); Giacomo Crotti, Pisa (IT)

(73) Assignee: Intier Automotive Closures S.p.A., Casine Vica Rivoli (IT)

( * ) Notice: Subject to any disclaimer, the term of this patent is extended or adjusted under 35 U.S.C. 154(b) by 0 days.

(21) Appl. No.: 10/561,202

(22) PCT Filed: Jul. 19, 2004

(86) PCT No.: PCT/EP2004/051542

§ 371 (c)(1),
(2), (4) Date: Nov. 6, 2006

(87) PCT Pub. No.: WO2005/012677

PCT Pub. Date: Feb. 10, 2005

(65) Prior Publication Data

US 2007/0271973 A1 Nov. 29, 2007

(30) Foreign Application Priority Data

Jul. 18, 2003 (IT) ..... TO2003A0557

(51) Int. Cl.
*E05C 3/06* (2006.01)

(52) U.S. Cl. ..... 292/216; 292/DIG. 23

(58) Field of Classification Search ..... 292/216, 292/201, DIG. 23, DIG. 43
See application file for complete search history.

(56) References Cited

U.S. PATENT DOCUMENTS

| | | | | |
|---|---|---|---|---|
| 3,666,305 A | | 5/1972 | Schlichter | |
| 4,203,621 A | * | 5/1980 | Noel et al. | 292/216 |
| 5,769,468 A | * | 6/1998 | Armbruster | 292/201 |
| 6,109,671 A | * | 8/2000 | Roncin et al. | 292/216 |
| 6,113,161 A | | 9/2000 | Jung et al. | |

FOREIGN PATENT DOCUMENTS

| | | |
|---|---|---|
| EP | 0 534 076 | 7/1992 |

* cited by examiner

*Primary Examiner*—Gary Estremsky
(74) *Attorney, Agent, or Firm*—Clark Hill PLC

(57) ABSTRACT

Described herein is a lock for a door of a motor vehicle provided with a closing mechanism designed to cooperate with a lock striker fixed to an upright of the door itself; the closing mechanism is provided with: a fork, which can assume an opening position, in which it enables engagement and disengagement between the lock striker and a seat thereof, and a closing position, in which it withholds the lock striker within its seat and prevents disengagement thereof; a dog coupled via snapaction with the fork for blocking it in a releasable way in the closing position; and an auxiliary lever, which can be actuated by the fork during coupling with the lock striker for exerting an action of thrust on the dog and causing it to couple with the fork itself.

12 Claims, 2 Drawing Sheets

LOCK FOR A DOOR OF A MOTOR VEHICLE

TECHNICAL FIELD

The present invention relates to a lock for a door of a motor vehicle.

It is pointed out that the term <<door>> is used, in the present description and in the ensuing claims, in its widest sense to indicate any element that can move between an opening position and a closing position of an access opening to an internal compartment of a motor vehicle. The aforesaid term therefore comprises, in addition to the side doors of the motor vehicle, to which explicit reference will be made in the ensuing description without this entailing any loss of generality, also the bonnet or the boot or the hatchback.

BACKGROUND ART

As is known, locks for motor vehicles generally comprise a supporting body designed to be fixed to a door of the motor vehicle, and a closing mechanism carried by the supporting body and designed to couple with a lock striker fixed to an upright of the frame of the door itself. There exist moreover solutions, used much more rarely, in which the supporting body of the lock is constrained to the upright, and the lock striker is instead fixed to the door.

In both cases, the closing mechanism is formed basically by a fork and a dog or catch hinged to the supporting body about respective fixed axes parallel to one another.

The fork has an engagement seat for a generally cylindrical portion of the aforesaid lock striker, is elastically loaded towards an opening position, in which it enables engagement and disengagement between the lock striker and its seat, and can assume a closing position, in which it withholds the cylindrical portion of the lock striker within its seat and prevents disengagement thereof.

The dog is pushed by a spring to couple via snap-action, by means of an engagement edge thereof, with a peripheral retention shoulder of the fork for blocking the latter in a releasable way in the closing position.

In particular, following upon slamming of the door, the fork is displaced, under the thrust of the lock striker, from the opening position to an overtravel position set beyond the closing position; during the stretch of travel comprised between the closing position and the overtravel position, the fork passes, with its own retention shoulder, beyond the dog, enabling the latter to snap, with its own engagement edge, into a position facing the aforesaid shoulder. During the subsequent elastic return of the fork towards the opening position, the retention shoulder sets itself bearing upon the engagement edge of the dog, which thus defines the closing position of the fork itself on the lock striker.

In the case of presence of dirt or formation of ice inside the lock, the dog may be slowed down in its movement towards the position of coupling with the fork so that, as the door comes close to the corresponding frame, closing does not occur, with a consequent bouncing back of the door itself.

DISCLOSURE OF INVENTION

The purpose of the present invention is to provide a lock for a door of a motor vehicle, which will enable the drawback specified above inherent in known locks to be overcome, in a simple and inexpensive way.

The aforesaid purpose is achieved by the present invention, in so far as it relates to a lock for a door of a motor vehicle comprising a closing mechanism designed to co-operate with a lock striker, said closing mechanism comprising:

- a fork which can assume an opening position, in which it enables engagement and disengagement between said lock striker and a seat thereof, and a closing position, in which it withholds said lock striker within its seat and prevents disengagement thereof; and
- a dog coupled by snap-action with said fork for blocking it in a releasable way in said closing position;

said lock being characterized in that it comprises auxiliary lever means which can be actuated by said fork during coupling with said lock striker to exert an action of thrust on said dog and cause it to couple with the fork itself.

BRIEF DESCRIPTION OF THE DRAWINGS

For a better understanding of the present invention a preferred embodiment is described in what follows, purely by way of non-limiting example and with reference to the annexed drawings, in which.

BEST MODE FOR CARRYING OUT THE INVENTION

Figure 1:
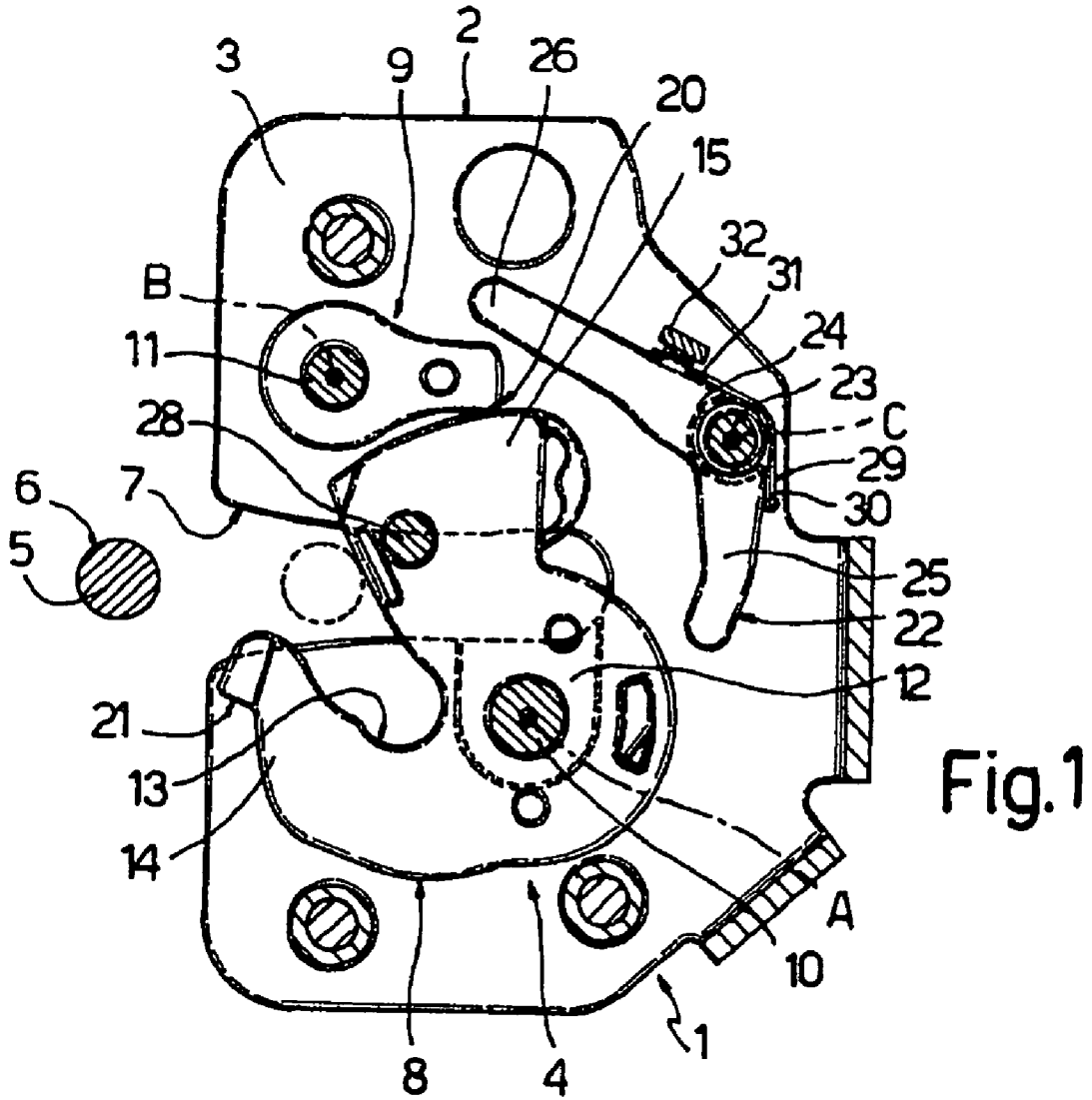
FIG. 1 is a front view, partially sectioned and with parts removed for reasons of clarity, of a lock for a door of a motor vehicle, made according to the present invention and set in an opening condition.

With reference to the annexed figures, designated, as a whole, by 1 is a lock for a door of a motor vehicle (the door and the motor vehicle not being illustrated).

The lock 1 basically comprises a box-type supporting body 2, of which, for reasons of clarity, only a plate 3 is illustrated, which is designed to be fixed to the aforesaid door, and a closing mechanism 4, which is constrained to the supporting body 2 and is designed to co-operate with a cylindrical portion 5 of a lock striker 6 represented only in part, fixed to a fixed upright (not illustrated) of the door itself.

In particular, the plate 3 defines a C-shaped side opening 7 designed to receive the portion 5 of the lock striker 6 during closing of the door.

The closing mechanism 4 basically comprises a fork 8 and a dog 9, which are hinged about respective fixed pins 10, 11, which are, in turn, fixed to the plate 3 and have respective axes A, B parallel to one another and orthogonal to the plate 3 itself.

The fork 8 is constituted by a shaped plate made of metal material, is hinged in an area corresponding to an intermediate portion 12 thereof about the pin 10 and has a C-shaped peripheral seat 13, which is designed to house the portion 5 of the lock striker 6 and is delimited laterally by a pair of teeth 14, 15.

Conveniently, the fork 8 is coated externally by a shell made of plastic material, from which there exit the free ends of the teeth 14 and 15 delimiting the seat 13.

The fork 8 is pushed in a known way, by a spring (not illustrated) wound around the pin 10 and constrained to the fork 8 itself and to the plate 3 towards an opening position (see FIG. 1), in which the seat 13 faces in the same direction as the opening 7 of the plate 3 and thus enables engagement and disengagement of the portion 5 of the lock striker 6; the fork 8 can, moreover, assume a closing position (see FIG. 2), in which it blocks the portion 5 of the lock striker 6 within its seat 13 and prevents exit thereof, by intercepting the opening 7 with the tooth 14.

The dog 9 is formed by a shaped plate designed to couple via snap-action with the fork 8 for blocking it in a releasable way in the closing position.

In particular, the dog 9 extends basically on the same plane of lie as the fork 8, is hinged to the pin 11 in an area corresponding to one end thereof and is designed to engage via snap-action, by means of an opposite L-shaped end edge 20 of its own, with a shoulder 21 made along the peripheral edge of the tooth 14 of the fork 8 on the opposite side to the side that delimits the seat 13.

The dog 9 is pushed in a known way towards the fork 8 by a cylindrical helical spring (not illustrated) wound around the pin 11 and constrained to the dog 9 itself and to the plate 3.

In particular, following upon slamming of the door, the fork 8 is designed to be displaced, under the thrust of the portion 5 of the lock striker 6, from the opening position to an overtravel position (FIG. 3) set beyond the closing position; during the stretch of travel comprised between the closing position and the overtravel position, referred to briefly in what follows as "overtravel", the fork 8 passes, with its own shoulder 21, beyond the dog 9, enabling the latter to snap, with its own end edge 20, into a position facing the shoulder 21 itself. In the course of the subsequent elastic return of the fork 8 towards the opening position, the shoulder 21 sets itself bearing upon the end edge 20 of the dog 9, which thus defines the closing position of the fork 8 itself on the lock striker 6.

According to an important aspect of the present invention, the closing mechanism 4 further comprises an auxiliary lever 22, which can be actuated by the fork 8 during coupling with the portion 5 of the lock striker 6 to exert an action of thrust on the dog 9 and cause it to couple with the fork 8 itself.

In particular, the auxiliary lever 22 is hinged to the plate 3 by means of a pin 23 having an axis C parallel to the axes A and B, and is set in a position facing the fork 8 and the dog 9 and substantially alongside the fork 8 and dog 9 themselves.

Preferably, the auxiliary lever 22 is approximately L-shaped and comprises an intermediate portion 24 hinged to the pin 23, and an actuating arm 25 and a thrust arm 26, which project in cantilever fashion from the intermediate portion 24, form with one another an angle slightly greater than 90°, and are designed to co-operate with the fork 8 and with the dog 9, respectively.

In particular, the thrust arm 26 of the auxiliary lever 22 extends on the same plane of lie as the fork 8 and the dog 9, whilst the actuating arm 25 extends parallel and in a position above the plane of lie of the fork 8 itself.

The actuating arm 25 is designed to receive, during overtravel displacement of the fork 8, i.e., during displacement from the closing position (see FIG. 2) to the overtravel position (see FIG. 3), thrust forces from a pin 28 projecting orthogonally in cantilever fashion from the tooth 15 of the fork 8 itself.

As a result of the thrust received on its actuating arm 25, the auxiliary lever 22 is designed to rotate about the axis C so as to bring about interaction of the thrust arm 26 with the dog 9.

In particular, the thrust arm 26 extends on the opposite side of the dog 9 with respect to the fork 8 and, following upon the rotation imposed on the auxiliary lever 22 by the interaction between the pin 28 and the actuating arm 25, is designed to exert an action of thrust on the dog 9 in the direction of coupling with the fork 8 itself.

The solution described, which uses for the actuation of the auxiliary lever 22 a pin 28 set within the lateral profile of the fork 8, enables the overall dimensions of the closing mechanism 4 to be limited to the minimum, by bringing the auxiliary lever 22 itself into the position as close as possible to the fork 8 and the dog 9. In general, there derives therefrom a reduction in the overall dimensions of the plate 3, which supports the closing mechanism 4, and of the lock 1.

According to a possible alternative (not illustrated), the fork 8 could co-operate with the actuating arm 25 of the auxiliary lever 22 by means of an appropriately shaped stretch of its own peripheral edge.

This solution, albeit presenting the same effectiveness as the one described and illustrated above, would not, however, enable the overall dimensions of the closing mechanism 4 and, hence, of the corresponding lock 1 to be limited to the minimum.

Figure 2:
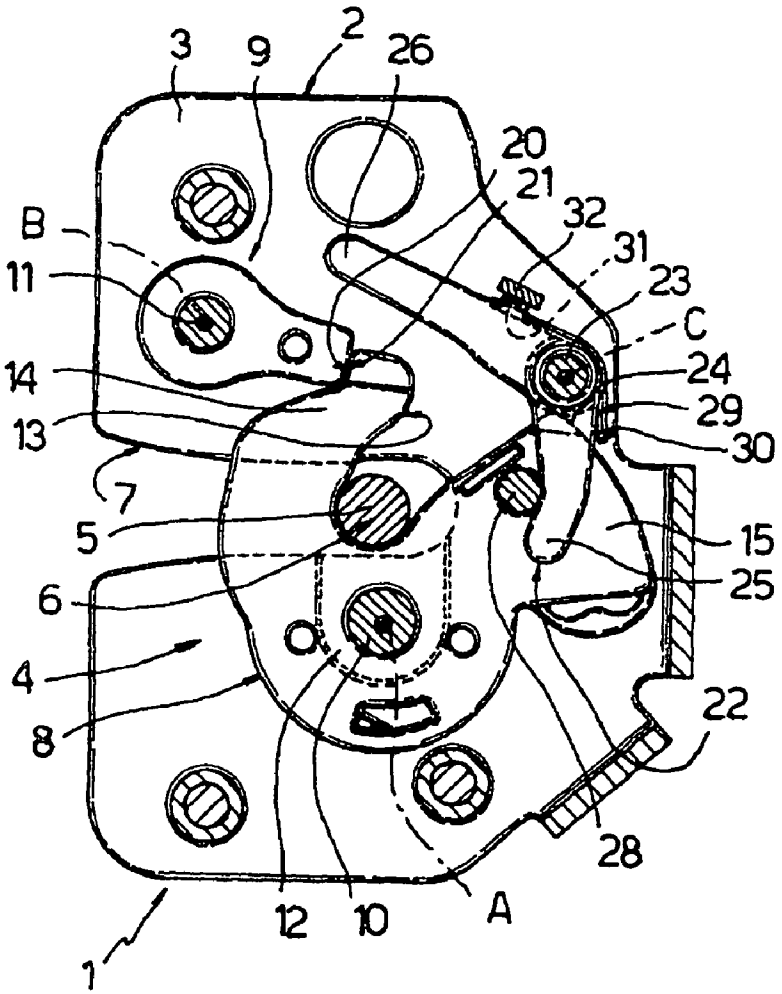
FIG. 2 is a front view, partially sectioned and with parts removed for reasons of clarity, of the lock of FIG. 1 in a closing condition.

According to a preferred embodiment of the present invention, the auxiliary lever 22 is loaded by a cylindrical helical spring 29 towards a resting position, in which said lever 22 is detached from the dog 9 (see FIGS. 1 and 2).

In particular, the spring 29 is wound around the pin 23 and has an end portion 30 constrained to the plate 3 in a position adjacent to the actuating arm 25, and an opposite end portion 31 constrained to an appendage of the thrust arm 26 so as to bring it up against a projection 32 of the plate 3 set on the opposite side of the thrust arm 26 itself with respect to the fork 8 and to the dog 9.

Figure 3:
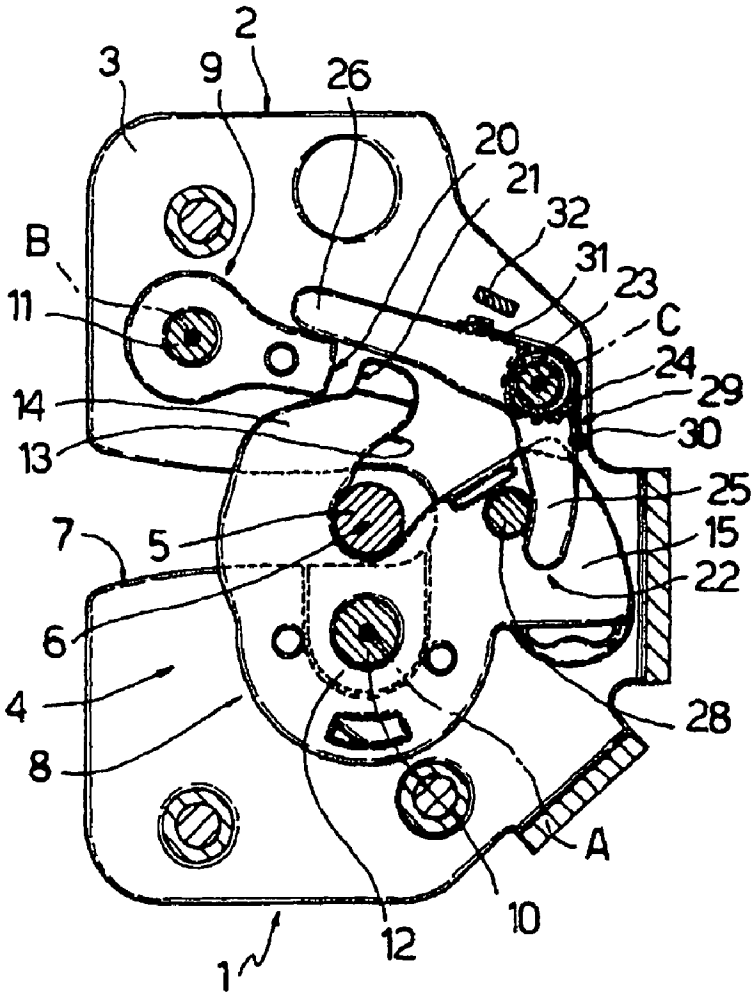
FIG. 3 is a front view, partially sectioned and with parts removed for reasons of clarity, of the lock of FIG. 1 in a step of displacement towards the closing condition.

In use, closing of the lock 1 from outside or from inside the motor vehicle occurs by simple slamming of the door; in this way, there occurs an impact of the portion 5 of the lock striker 6 on the tooth 15 of the fork 8, which rotates in a clockwise direction from the opening position of FIG. 1 towards the closing position and overtravel position of FIGS. 2 and 3.

Rotation of the fork 8 initially brings about a sliding of the peripheral edge of the teeth 14 and 15 on the end edge 20 of the dog 9. As soon as the shoulder 21 of the tooth 14 passes beyond the end edge 20, the dog 9, under the thrust of its spring, snaps further towards the fork 8, which completes its travel reaching the overtravel position (see FIG. 3).

During the overtravel rotation of the fork 8, i.e., beyond the closing position, the pin 28 intercepts the actuating arm 25 setting in rotation the auxiliary lever 22 in a counterclockwise direction about the axis C, against the force of the spring 29.

As a result of said rotation, the thrust arm 26 of the auxiliary lever 22 is brought into contact with the dog 9 so as to push it towards the fork 8, whenever the dog 9 itself has not in turn snapped into the position suitable for blocking the fork 8 in the closing position.

Simultaneously, the fork 8, once it has reached the overtravel position, is displaced in an opposite direction towards the opening position under the thrust of its spring. During this motion, the shoulder 21 of the tooth 14 of the fork 8 is intercepted by the end edge 20 of the dog 9, and thus blocks the fork 8 itself in the closing position. The auxiliary lever 22, once the action of thrust of the pin 28 has ceased, can then return, as a result of the action of return of the spring 29, into its resting position, in which it is set bearing upon its own thrust arm 26 against the projection 32 of the plate 3 and is detached from the dog 9 (see FIG. 2).

From an examination of the characteristics of the lock 1 made according to the present invention the advantages that it enables are evident.

In particular, the simple arrangement of the auxiliary lever 22 ensures, whatever the condition of operation (presence of ice or of dirt inside the lock 1), coupling via snap-action between the dog 9 and the fork 8 and, hence, regular closing of the door.

Finally, it is clear that modifications and variations can be made to the lock 1, without thereby departing from the field of protection of the present invention.

In particular, the lock 1 could be fixed to the upright of the door and could co-operate with a lock striker fixed to the door itself.

The invention claimed is:

1. A lock (1) for a door of a motor vehicle including a closing mechanism (4) designed to co-operate with a lock striker (6), said closing mechanism (4) comprising:

a fork (8) which can assume an opening position, in which it enables engagement and disengagement between the lock striker (6) and a seat (13) thereof, and a closing position, in which it withholds the lock striker (6) within its seat (13) and prevents disengagement thereof;

a dog (9), which can be coupled via snap-action with said fork (8) for blocking it in a releasable way in said closing position; and an auxiliary lever (22), which can be actuated by said fork (8) during coupling with the lock striker (6) for exerting an action of thrust on said dog (9) and causing it to couple with said fork (8) itself, wherein said auxiliary lever (22) is biased towards a position of detachment from said dog (9).

2. The lock according to claim 1 wherein said fork (8) is elastically loaded towards said opening position, can be displaced, under the thrust of the lock striker (6), from said opening position to an overtravel position set beyond said closing position, and can be coupled via snap-action with said dog (9) during the elastic return from said overtravel position to said closing position, said fork (8) co-operating with said auxiliary lever (22) between said closing and overtravel positions.

3. The lock according to claim 2 wherein said fork (8) and said dog (9) can rotate about a first axis (A) and a second axis (B) parallel to one another, and wherein said auxiliary lever (22) can rotate about a third axis (C) parallel to said first and second axes (A, B) and has an actuating portion (25), co-operating with said fork (8), and a thrust portion (26), co-operating with said dog (9).

4. The lock according to claim 3 wherein said lever (22) is basically L-shaped and includes an intermediate portion (24), rotatable about said third axis (C), and two arms (25, 26), which project in cantilever fashion from said intermediate portion (24) and define said actuating portion and said thrust portion.

5. The lock according to claim 4, wherein said lever (22) is biased by a spring (29) towards said position of detachment from said dog (9).

6. The lock according to claim 5 wherein said fork (8) has, within its own lateral profile, an interaction portion (28) for interaction with said auxiliary lever (22), which projects in cantilever fashion from said fork (8) itself, and wherein said auxiliary lever (22) is set, at least in an area corresponding to the actuating portion (25) designed to co-operate with said interaction portion (28) of said fork (8), on a plane parallel to the plane of lie of the fork (8) itself.

7. A lock (1) for a door of a motor vehicle designed to co-operate with a lock striker (6), said lock (1) comprising:

a plate (3);

a fork (8) including a seat (13), which can assume an opening position enabling engagement and disengagement between the lock striker (6) and said seat (13), and a closing position withholding the lock striker (6) within said seat (13) to prevent disengagement therefrom;

a dog (9), which can be coupled via snap-action with said fork (8) for blocking said fork (8) in a releasable way in said closing position; and an auxiliary lever (22) rotatably mounted directly to said plate (3), wherein said auxiliary lever (22) is actuated by said fork (8) during coupling of said fork (8) with the lock striker (6) thereby exerting an action of thrust on said dog (9) and causing said dog (9) to couple with said fork (8), and wherein said auxiliary lever (22) is biased towards a position of detachment from said dog (9).

8. The lock according to claim 7 wherein said auxiliary lever (22) is actuated by said fork (8) when said fork (8) fork rotates to an overtravel position beyond said closing position.

9. The lock according to claim 8 wherein said auxiliary lever (22) is detached from said dog (9) when said fork (8) is in said opening position.

10. The lock according to claim 9 wherein said auxiliary lever (22) is detached from said dog (9) when said fork (8) is in said closing position.

11. A lock (1) for a door of a motor vehicle designed to co-operate with a lock striker (6), said lock (1) comprising:

a fork (8) including a seat (13) for receiving the lock striker (6) therein, said fork (8) rotatably mounted to the lock (1) for movement between an opening position enabling engagement and disengagement between the lock striker (6) and said seat (13), and a closing position withholding the lock striker (6) within said seat (13) to prevent disengagement therefrom;

a dog (9) rotatably mounted to the lock (1) for engagement with said fork (8) for blocking said fork (8) in a releasable way in said closing position; and an auxiliary lever (22) rotatably mounted to the lock (1) separately from said dog (9), wherein said fork (8) abuts said auxiliary lever (22) during coupling of said fork (8) with the lock striker (6), thereby rotating said auxiliary lever (22) and causing said auxiliary lever (22) to abut said dog (9), thereby rotating said dog (9) and causing said dog (9) to couple with said fork (8).

12. The lock according to claim 11 wherein said auxiliary lever (22) is biased towards a position of detachment from said dog (9).

* * * * *